United States Patent [19]

Fausett, Sr.

[11] Patent Number: 4,889,191

[45] Date of Patent: Dec. 26, 1989

[54] GOOSENECK ASSEMBLY FOR ROCK DRILL AND METHOD FOR INSERTING FRICTION ROCK STABILIZER

[76] Inventor: C. Lovon Fausett, Sr., P.O. Box 968, Osburn, Id. 83849

[21] Appl. No.: 256,491

[22] Filed: Oct. 12, 1988

[51] Int. Cl.[4] ..... E21D 20/00

[52] U.S. Cl. ..... 173/1; 173/36; 299/11; 405/259

[58] Field of Search ..... 173/1, 32–36, 173/129, 132; 299/11; 405/259, 288

[56] References Cited

U.S. PATENT DOCUMENTS

| | | | |
|---|---|---|---|
| 835,261 | 11/1906 | Smith et al. | 173/36 |
| 1,321,272 | 11/1919 | Jurich | 173/131 |
| 3,085,638 | 4/1963 | Larcen | 173/36 |
| 3,106,257 | 10/1963 | Helm | 173/32 |
| 3,499,497 | 3/1970 | Moore | 175/135 |
| 3,721,094 | 3/1973 | Elders et al. | 299/11 X |
| 3,922,867 | 12/1975 | Scott | 61/45 B |
| 4,033,419 | 7/1977 | Pennington | 173/34 |
| 4,289,426 | 9/1981 | Chaiko | 405/259 |
| 4,327,806 | 5/1982 | Arya | 173/131 |
| 4,473,325 | 9/1984 | Beney et al. | 405/259 X |
| 4,530,409 | 7/1985 | Arya | 173/131 |
| 4,589,501 | 5/1986 | Arya | 173/131 |

OTHER PUBLICATIONS

Ingersoll-Rand Publication.

*Primary Examiner*—Douglas D. Watts
*Assistant Examiner*—James L. Wolfe
*Attorney, Agent, or Firm*—Wells, St. John & Roberts

[57] ABSTRACT

A gooseneck interposed between a rock drill and supporting jack leg includes an offset pivot bearing for the rock drill and an adjacent pin to facilitate initial insertion of a friction rock stabilizer into a receiving hole. Use of the gooseneck involves alignment of the jack leg and stabilizer, followed by simultaneous operation of the rock drill and jack leg to force the stabilizer into the hole while vibrating it.

9 Claims, 3 Drawing Sheets

GOOSENECK ASSEMBLY FOR ROCK DRILL AND METHOD FOR INSERTING FRICTION ROCK STABILIZER

TECHNICAL FIELD

This disclosure relates to improvements in tools and procedures for initially inserting the inner end of a friction rock stabilizer within a hole drilled into a mine wall or ceiling.

BACKGROUND OF THE INVENTION

In recent years, friction rock stabilizers, particularly those sold under the trademark "Split Set", by Ingersoll-Rand Equipment Corporation, have become quite popular for stabilizing or anchoring metal mine roofs. These stabilizers are manufactured in the form of split tubes, varying in length from three feet to eight feet, and are exemplified by the disclosure of U.S. Pat. No. 3,922,867, issued Dec. 2, 1975, to James J. Scott, for "Friction Rock Stabilizer". Pneumatic insertion tools like jackdrills and stopers are frequently used for installation of these stabilizers.

Jackdrills and stopers have a minimum working height of about five feet. Accordingly, in low headroom mines, friction rock stabilizers cannot be installed, directly, with standard jackdrills or stopers. A special tool or accessory is required which, when used with conventional drivers (such as jackdrills or stopers), will enable the insertion of the stabilizers into low headroom mine roofs or the like.

Examples of a special accessory for use in low headroom situations are found in U.S. Pat. Nos. 4,327,806; 4,530,409; 4,589,501. These devices provide an offset driver stub that is mountable to one side of the rock drill, the accessory being engaged in the chuck of the rock drill and being angularly adjustable for properly aligning the stabilizer relative to the receiving hole. However, the use of such a tool requires the maintenance of an additional separable accessory for the rock drill. Like all separable tools, such accessory devices are subject to loss and damage, particularly within the difficult working environments typically encountered within a mine. Its utilization also complicates mining procedures by introducing an additional tool change. One using such an accessory must first mount it within the chuck of the rock drill. Then the user must substitute a conventional stabilizer driver to complete the insertion of the stabilizer, since the longitudinal offset of the accessory inherently limits the total insertion capability of the accessory.

A rigid gooseneck typically interconnects the rock drill to a supporting jack leg that is extendible longitudinally to properly support the rock drill and move it toward the working face of a mine. The pivot axis of the rock drill relative to the gooseneck is offset to one side of the longitudinal axis of the jack leg, assuring free pivotal movement of the rock drill at any elevational position of the jack leg.

One object of this invention is to provide an integral driver on the gooseneck for engaging and initially inserting friction rock stabilizers without the need of a separable accessory tool. The improved gooseneck permits initial insertion of the friction rock stabilizer by use of the pneumatic jack leg in combination with the vibrational movement imparted to the gooseneck by operation of the attached rock drill. Final insertion can then be readily accomplished by use of a conventional driver tool mounted within the chuck of the rock drill. Only one tool change is required for complete insertion of a stabilizer, rather than two.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

The use of elongated friction rock stabilizers, such as longitudinally split rock bolts, in the walls and ceilings of mines requires that the stabilizers are forced longitudinally into previously-drilled holes. There is often insufficient clearance within the mine area for longitudinally aligning the end of a rock drill with the outer end of the stabilizer. For instance, in mines having a ten foot ceiling height, the use of a six foot bolt leaves only four additional feet at the foot of the mine for access to the lower end of the stabilizer, which must be driven upwardly. This is insufficient clearance for a conventional rock drill mounted to a jack leg and having a conventional driver tool mounted in its chuck. However, once the stabilizer has progressed into the hole by approximately one foot in length, sufficient clearance is available and conventional driving techniques can be utilized. The present invention arose from a need to provide means on a conventional drill assembly for effectively and efficiently assuring that the friction rock stabilizers can be initially inserted properly into the receiving hole.

Figures 3, 4:
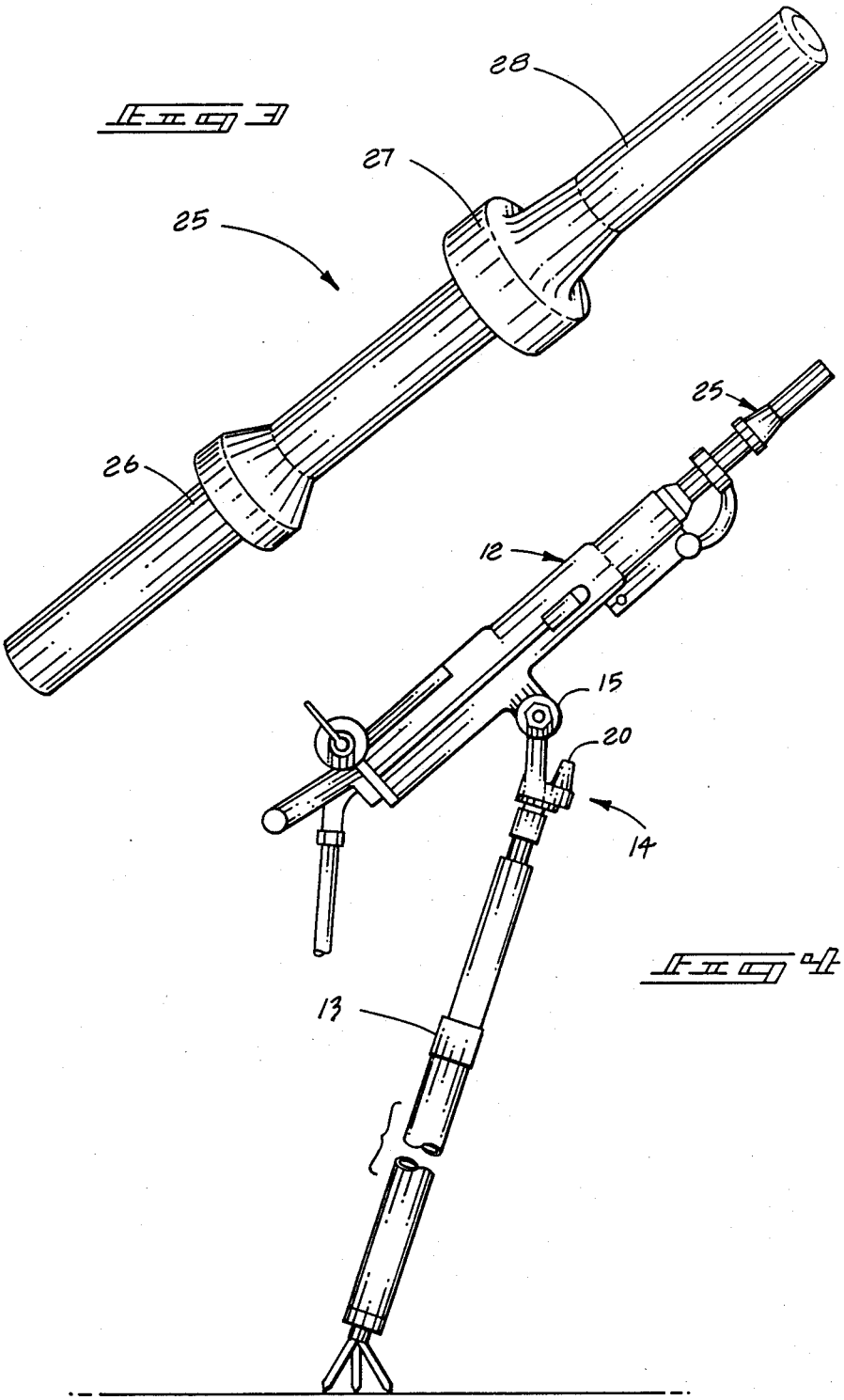
FIG. 3 is a perspective view of a conventional driver tool for friction rock stabilizers.
FIG. 4 is a fragmentary side elevational view of a rock drill having the conventional driver tool mounted in its chuck, and supported at the inner end of a jack leg interconnected to the rock drill by a gooseneck constructed according to the present disclosure.

FIG. 3 illustrates a conventional driver tool 25 for mounting within the chuck of a rock drill. Such tools are used for inserting friction rock stabilizers where sufficient clearance is available to utilize it. Tool 25 includes a supporting shank 26 adapted to be locked in the chuck of a rock drill, a radially protruding shoulder 27, and a cylindrical extension 28 complementary in size to the interior of the ring flange 23 and tube of a friction rock stabilizer structure. When mounted within a rock drill 12, as shown in FIG. 4, the driver tool 25 is simply aligned as a coaxial extension of the friction rock stabilizer within which it is inserted. The reciprocating and vibratory movement imparted to the stabilizer by operation of the rock drill and supporting jack leg can rapidly force the stabilizer into the receiving hole.

Friction rock stabilizers are utilized for mine safety purposes. However, the difficulty of initially inserting such stabilizers has, in some instances, led to insertion practices that undermine the safe environment which the stabilizers are designed to produce. One "short cut" used in some instances is to simply cut off a section at the inner end of the stabilizer, thereby shortening its length and providing adequate clearance for driving purposes. Another technique is to widen the bore or hole adjacent to its outer end, thereby permitting initial insertion of the stabilizer without the desired frictional engagement adjacent to the face of the wall or the ceiling. Both of these "short cuts" sacrifice the desired stability of the wall or ceiling area intended along the full length of the stabilizer, and are particularly dangerous because such practices are not visually detectable after insertion of the stabilizer is complete. However, improper insertion of the stabilizers is physically detectable by testing the pulling pressure of the inserted stabilizers, which requires re-installation or other appropriate safety procedures. Where not detected, such "short cuts" can result in subsequent injury or death to people working in the affected mine area as the improperly stabilized wall or ceiling areas break apart or collapse.

The present gooseneck facilitates initial insertion procedures for such stabilizers. It helps to assure that workers in mines will not be tempted to take short cuts that would detract from the intended safe environment produced by use of the friction rock stabilizers. It provides a stabilizer-engaging driver integrally formed on the rigid body of a gooseneck and immediately available to the user for initially inserting the friction rock stabilizers by direct application of longitudinal force to the outer end of the stabilizer by operation of the pneumatic jack leg.

Gooseneck 14 provides the conventional interconnection between the pneumatic rock drill 12 and a supporting pneumatic jack leg 13. Rock drill 12 typically imparts vibratory and reciprocating forces to a tool held in its chuck. The jack leg 13 is an elongated cylinder that can be extended or retracted to assist in supporting rock drill 12 as a drill or other tool is used in a mine environment.

Figure 5:
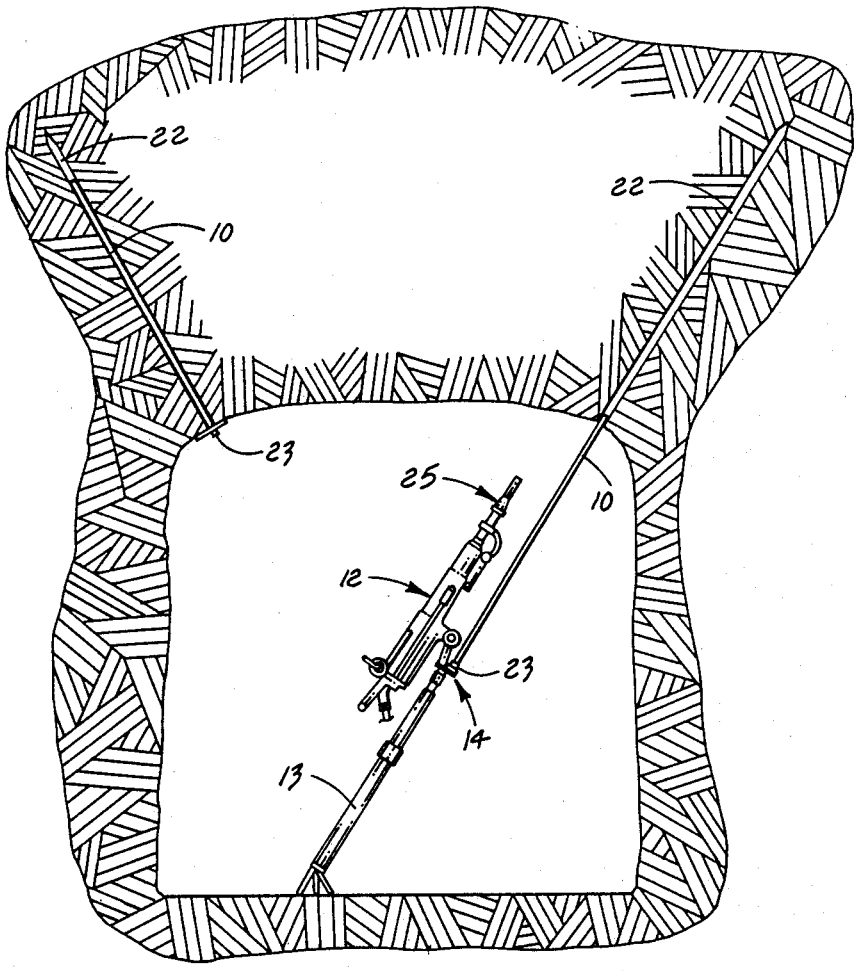
FIG. 5 is a view illustrating the manner by which the present gooseneck is used for initially inserting a friction rock stabilizer into a previously-drilled hole in a wall or ceiling of a mine.

Referring to FIG. 5, which illustrates use of the subject invention, the friction rock stabilizers 10 constitute an elongated longitudinal split tube that is driven longitudinally straight into a hole 22 drilled into the face of a wall or ceiling within a mine. The diameter of hole 22 is slightly less than the uncompressed split tube diameter. The inner end of the tube is normally tapered for easy insertion into a drilled hole. The outer end has a welded ring flange 23 for retaining a roof plate and for facilitating the application of longitudinal driving forces to the elongated tube. Because of its slotted nature, the tube exerts outward compressive forces against the rock, anchoring itself tightly and securely in the surrounding rock structure.

Figure 2:
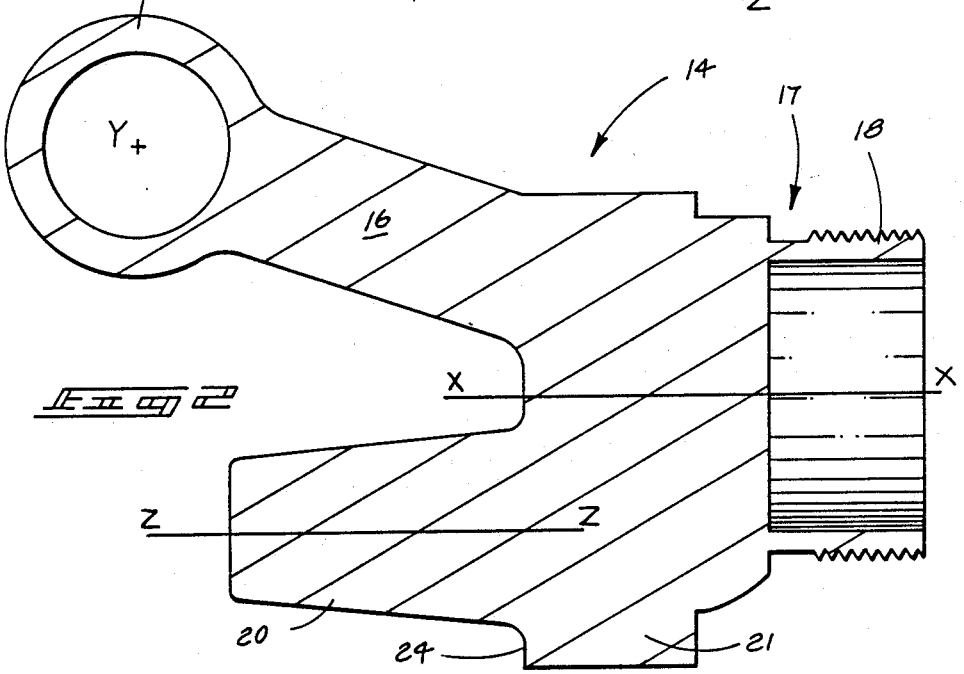
FIG. 2 is an enlarged sectional view taken through the center of the gooseneck.

The gooseneck 14 according to this disclosure comprises a rigid body having three components. The first is a base 17 at one end of the rigid body. Base 17 is provided with cylindrical threads 18 for attaching the gooseneck to the upper end of a conventional jack leg 13. The attachment means provided by base 17 is formed about a longitudinal central axis on the rigid body indicated by line X—X in FIG. 2. Pivot bearing means is provided on the rigid body of gooseneck 14 for mounting a rock drill about a transverse axis. This is illustrated by bearing 15 at the outer end of a solid fixed angular support arm 16.

Figure 1:
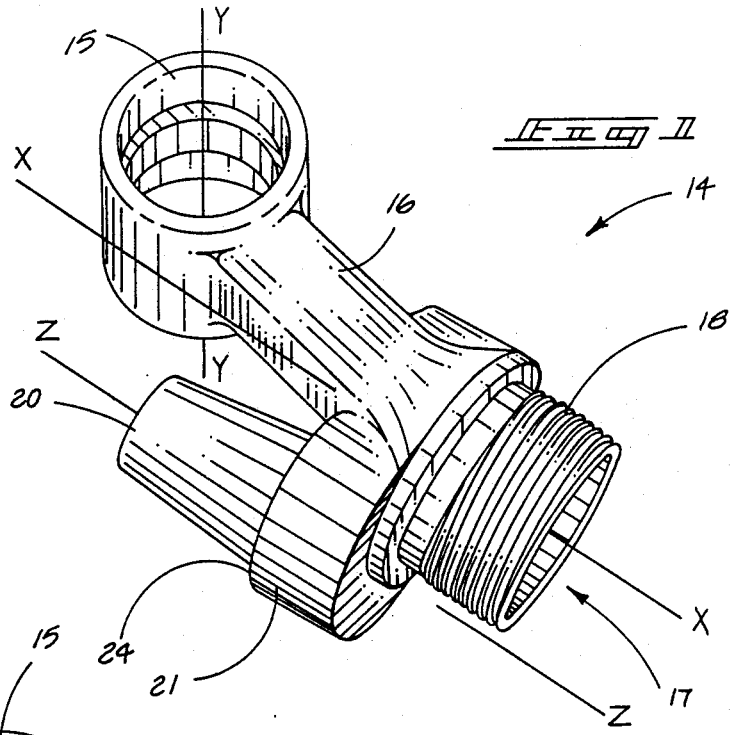
FIG. 1 is a perspective view of the gooseneck.

The bearing 15 is formed about a transverse axis (seen as line Y—Y in FIG. 1 and point Y in FIG. 2) that is spaced to one side of the longitudinal central axis X—X. A stabilizer-engaging driver is offset to the remaining side of the axis X—X. The stabilizer-engaging driver is illustrated by a protruding short tapered pin 20 having a shoulder 21 surrounding its inner end. The central axis of pin 20 is shown by line Z—Z in FIG. 2. Axis Z—Z lies to the side opposite axis X-X relative to the axis Y—Y through the center of bearing 15. The longitudinal central axis X—X of base 17 on gooseneck 14 and the central axis Z—Z through the protruding pin 20 are located within a common plane that is perpendicular to the transverse axis Y—Y of bearing 15.

The short tapered pin 20 has an exterior configuration complementary to the outer opening within ring flange 23 at the engaged end of the friction rock stabilizer 10. The tapered nature of pin 20 facilitates its insertion into the outer end of stabilizer 10, and centers the surface 24 that surrounds pin 20 on the protruding shoulder 21. Shoulder 21 has an outwardly facing surface 24 extending about the circumference of pin 20 by a width equal to or greater than the annular width of the ring flange 23 on the stabilizer 10. It is designed to engage and push against ring flange 23 during use of pin 20.

Pin 20 is substantially shorter than the extension 28 designed for engaging the outer end of a stabilizer in the conventional driver tool 25 (FIG. 3). This further minimizes the clearance required within a mine for use of the gooseneck 14 in initially inserting friction rock stabilizers. It also locates the outer end of pin 20 so that it does not protrude across the bearing 15 and interfere with the required pivotal movement of rock drill 12 on the jack leg 13.

Gooseneck 14 facilitates initial insertion of the stabilizer where there is insufficient clearance for use of the illustrated driver tool 25. This is accomplished as shown in FIG. 5. First, the inner end of the stabilizer 10, which is tapered, is substantially aligned within the opening of the receiving hole 22. Next, the ring flange 23 at the outer end of stabilizer 10 is engaged by the complementary surface 24 on gooseneck 14, with the short pin 20 inserted within the outer end of the stabilizer 10 in a coaxial position relative to the extended split tube. The outer end of the jack leg 13 is placed in engagement with a fixed surface that maintains the jack leg 13 substantially parallel to the hole within which the stabilizer 10 is being inserted.

As can be seen in FIG. 5, the stabilizer 10 is moved inwardly into the hole along an axis parallel to and offset to one side from the longitudinal center axis of the jack leg 13.

Initial insertion of stabilizer 10 is effected by operating the rock drill 12 to impart vibratory movement to gooseneck 14 and stabilizer 10 while simultaneously expanding the pneumatic jack leg 13. This forces the compressed split stabilizer partially into the receiving hole. Because the axes of pin 20 and base 17 are parallel, the forces exerted on the stabilizer 10 by jack leg 13 are aligned parallel to the stabilizer length, thereby efficiently and effectively moving the stabilizer 10 through the hole without any bending forces that might damage it.

In compliance with the statute, the invention has been designed in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A gooseneck assembly for attachment to a mining rock drill to facilitate initial insertion of an elongated friction rock stabilizer into a hole drilled into a mine wall, the gooseneck assembly comprising:

a rigid body having one end adapted to be fixed to a jack leg;

pivot bearing means on the rigid body for mounting a rock drill for movement relative to the rigid body;

and a stabilizer-engaging driver integrally formed on the rigid body and protruding outwardly from it at one side of the pivot bearing means.

2. The gooseneck assembly of claim 1 wherein the stabilizer-engaging driver comprises a pin surrounded by an inwardly-located circumferential shoulder adapted to engage one end of a friction rock stabilizer penetrated by the pin.

3. The gooseneck assembly of claim 2 wherein the one end of the rigid body and the pin of the stabilizer-engaging driver are aligned along parallel axes.

4. A gooseneck assembly for a mining rock drill, comprising:

a rigid body;

attachment means formed at one end of the rigid body along a longitudinal central axis for releasably fixing the rigid body to one end of a jack leg;

pivot bearing means on the rigid body for mounting a rock drill, the pivot bearing means being centered about a transverse axis spaced from the longitudinal central axis; and a stabilizer-engaging driver centered along a driver axis, the stabilizer-engaging driver being integrally fixed on the rigid body adjacent to the pivot bearing and including a projecting pin surrounded by a shoulder having an outwardly facing surface adapted to engage an outer end of a friction rock stabilizer while the pin is inserted within it, the driver axis being parallel to the longitudinal axis.

5. The gooseneck assembly of claim 4 wherein the transverse axis is offset to one side of the longitudinal axis.

6. The gooseneck assembly of claim 4 wherein the transverse axis is offset to one side of the longitudinal axis and the driver axis is offset to the remaining side of the longitudinal axis.

7. The gooseneck assembly of claim 4 wherein the longitudinal axis and driver axis are located within a common plane that is perpendicular to the transverse axis.

8. A method for initial insertion of a friction rock stabilizer into a hole drilled into a wall, comprising the following steps:

substantially aligning an inner end of the stabilizer with the opening of the hole;

engaging an outer end of the stabilizer with complementary surfaces on a gooseneck that interconnects a rock drill and a jack leg having an outer end in engagement with a fixed surface to maintain the jack leg substantially parallel to the hole; and operating the rock drill to vibrate the gooseneck and engaged stabilizer while simultaneously expanding the jack leg to force the inner end of the stabilizer partially into the hole.

9. The method of claim 8 wherein the stabilizer is moved inwardly into the hole along a parallel axis offset to one side from the longitudinal center axis of the jack leg.

* * * * *